US006193028B1

(12) United States Patent
Elizalde-Siller et al.

(10) Patent No.: US 6,193,028 B1
(45) **Date of Patent: *Feb. 27, 2001**

(54) REVERSIBLE FULCRUM FOR A STRUT

(75) Inventors: Hugo-Ramon Elizalde-Siller, Durango; Miguel-Angel Montes-Ramos; Humberto Hernandez-Vargas, both of Nuevo León, all of (MX)

(73) Assignee: Acertek, S.A. de C.V., Monterrey (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/234,803

(22) Filed: Jan. 19, 1999

(51) Int. Cl.[7] ..... B61H 13/36
(52) U.S. Cl. ..... 188/232; 188/229.6; 188/225.6
(58) Field of Search ..... 188/229.1, 229.6, 188/231, 232, 233, 219.1, 223.1, 226.1, 225.6, 228.6, 233.3, 3 R

(56) References Cited

U.S. PATENT DOCUMENTS

| | | | | |
|---|---|---|---|---|
| 950,640 | * | 3/1910 | Porter | 188/229.6 |
| 1,432,234 | * | 10/1922 | Crone | 188/229.6 |
| 1,473,116 | * | 11/1923 | Mayhew | 188/229.6 |
| 1,673,159 | * | 6/1928 | Rodman | 188/229.6 |
| 2,330,748 | * | 9/1943 | Sagstetter | 188/229.6 |
| 2,528,024 | * | 10/1950 | Whitney | 188/229.6 |
| 2,947,389 | * | 8/1960 | Spaeth | 188/229.1 |
| 3,115,221 | * | 12/1963 | Croft | 188/232 |

* cited by examiner

*Primary Examiner*—Michael Mar
*Assistant Examiner*—Thomas J. Williams
(74) *Attorney, Agent, or Firm*—Abelman, Frayne & Schwab

(57) ABSTRACT

A strut having a reversible fulcrum, which can be changed, from a left strut to a right strut, for using in brake beams of the type comprising; a compression member, a "V" shaped tension member having a central apex coupled to the ends of the compression member; a brake shoe linked to the each end of the compression member; and a strut, wherein the strut having a reversible fulcrum comprising: a fulcrum body having a first end and a second end, a central slot passing through a central portion of the fulcrum body at a side portion thereof and an off-center pinhole passing through the fulcrum body at a central portion of a front portion of the fulcrum body; a hollow bell joint, having a dome rotary coupled to a central portion of the tension member and a tubular open end at which the first end of the fulcrum body is coupled; and a crown joint having a first end including an internal annular border, rotary receiving the second end of the fulcrum body, and a second end having two opposite holding skirts to be coupled to the central apex of the tension member.

4 Claims, 5 Drawing Sheets

FIG. 2
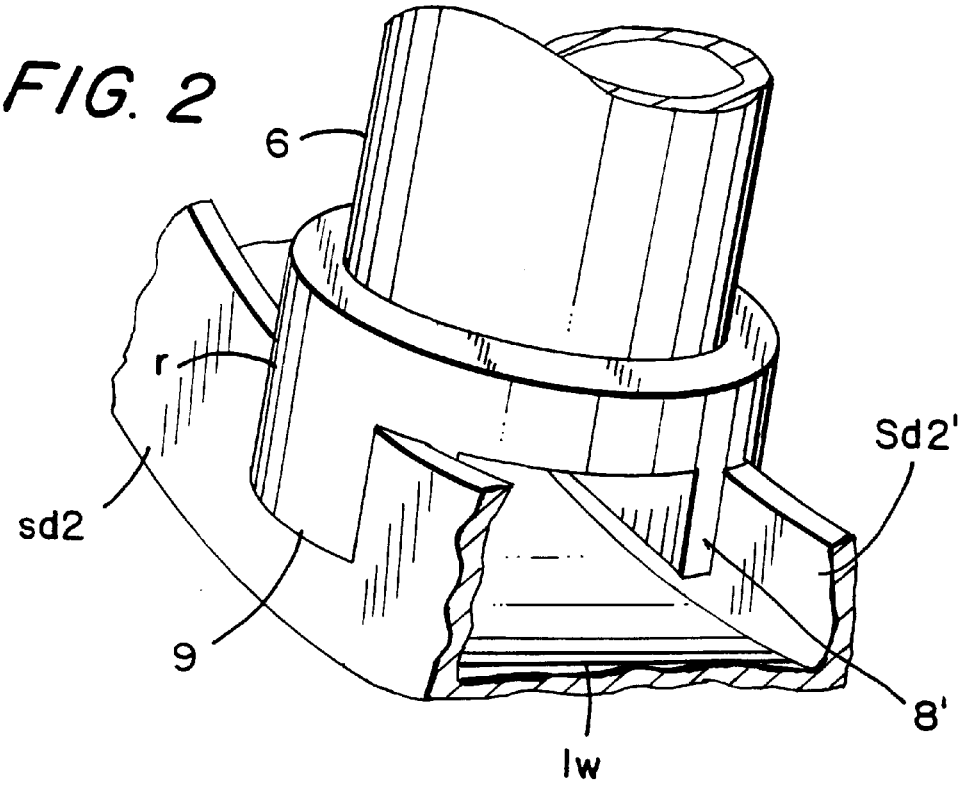
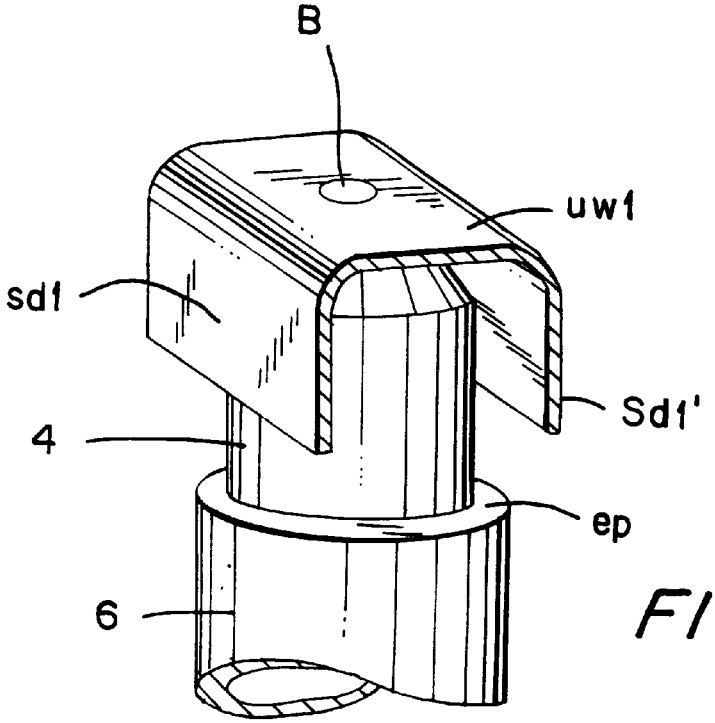
FIG. 3

REVERSIBLE FULCRUM FOR A STRUT

BACKGROUND OF THE INVENTION

A. Field of the Invention

This invention relates to brake beams, and more particularly to a strut having a reversible fulcrum for using in brake beams of railway cars, which can be changed, from a left strut to a right strut.

B. Description of the Related Art

There are well known brake shoe assemblies for railway cars by which a brake shoe is pressed against a wheel in order to decrease or stop the rotational speed of the wheel and railway car.

Generally, the brake shoe assembly is held by a structure called brake beam mounted transversely in the bogie of a railway car.

The brake beam generally comprises a compression member, a generally "V" shaped tension member having its ends coupled to the ends of the compression member, a brake shoe linked to the each end of the compression member, and a strut welded to the compression member and tension member, so that the strut remains between the tension and compression members. Said strut is linked to a lever, which applies a force in order to press the brake shoe against a wheel.

Because of the rigidity of this welded structure, several problems come up during normal use.

The lever-strut assembly is supposed to work at a 400 angle rigidly, however due to small gaps between components and undesirable forces produced by the railway car movements during running this angle normally varies few degrees, inducing high torsional moments over the strut and the lever itself. This dangerous and harming forces are translated to the compression and tension members, trough the whole brake beam, causing cock and wedge strengths when brakes are applied and a high wear of the lever-strut assembly components, making necessary a frequent maintenance.

Furthermore, depending on the orientation in which the brake beam is mounted in the bogie, it is necessary to provide right struts or left struts, and if a bogie uses more than two brake beams then right struts and left struts are also necessary.

Therefore, sometimes it is highly desirable that the strut could be able to be changed from a left strut to a right strut, which is impossible with the actual welded strut.

Considering the above referred problems, applicants developed a strut having a reversible fulcrum, which allow the strut to be converted from a left strut to a right strut or vice versa by rotating the main body of the strut around its own axis, making the strut reversible.

The invention is then referred to a strut having a reversible fulcrum, for using in brake beams of the type comprising: a compression member having a first and a second end; a "V" shaped tension member having a central apex, a first end coupled to the first end of the compression member, and a second end coupled to the second end of the compression member; a brake shoe linked to the each end of the compression member; and a strut, wherein the strut comprising: a pipe having a first end and a second end having a surrounding wall, a central slot passing through the surrounding wall at a side portion thereof and an off-center pinhole passing through the surrounding wall at a front portion thereof; a hollow bell joint, having a dome rotary coupled to a central portion of the compression member and a tubular open end at which the first end of the pipe is coupled; and a crown joint having a first end including an internal annular border, rotary receiving the second end of the pipe, and a second end having retaining means to be coupled to the central apex of the tension member.

In this way, the reversible fulcrum allows the strut to "follow" the lever's angular motion by oscillating about its own axis, releasing the torsional moment, which disappears. This feature allows the strut to work always in the same angular position as the lever, without generating reaction moments.

Another benefit of the strut having a reversible fulcrum of the present invention is that a lower wearing in the strut is achieved because of the lower contact forces between lever and strut, reducing considerably the maintenance costs, and the cock and wedge at the.

And last but not least, the reversible fulcrum allows to change the orientation of the brake beam, simply by rotating the off-central pinhole to change the strut from a right strut to a left strut and vice versa.

SUMMARY OF THE INVENTION

It is therefore a main objective of the present invention to provide a strut having a reversible fulcrum, which eliminates the torsional moments between the lever, and the strut.

It is also a main objective of the present invention to provide a strut having a reversible fulcrum, of the above disclosed nature, which allows the strut to be changed from a right strut to a left strut and vice versa.

It is another object of the present invention, to provide a strut having a reversible fulcrum, of the above disclosed nature, which allows the strut to "follow" the angular motion of the lever, eliminating the torsional moment.

It is also a main objective of the present invention, to provide a strut having a reversible fulcrum, of the above disclosed nature, in which the cock and wedge strengths.

It is still a main objective of the present invention, to provide a strut having a reversible fulcrum, of the above disclosed nature, in which the wear is reduced due to the lower contact forces between lever and strut, reducing the maintenance costs.

These and other objects and advantages of the strut having a reversible fulcrum, of the present invention will become apparent to those persons having an ordinary skill in the art, from the following detailed description of the embodiments of the invention which will be made with reference to the accompanying drawings.

BRIEF DESCRIPTION OF THE DRAWINGS

FIG. 2 is a partial perspective view of the crown joint, coupled to the apex of the tension member and to the fulcrum.

FIG. 3 is a partial perspective view of the hollow bell joint, coupled to the compression member and to the fulcrum;

Figure 1:
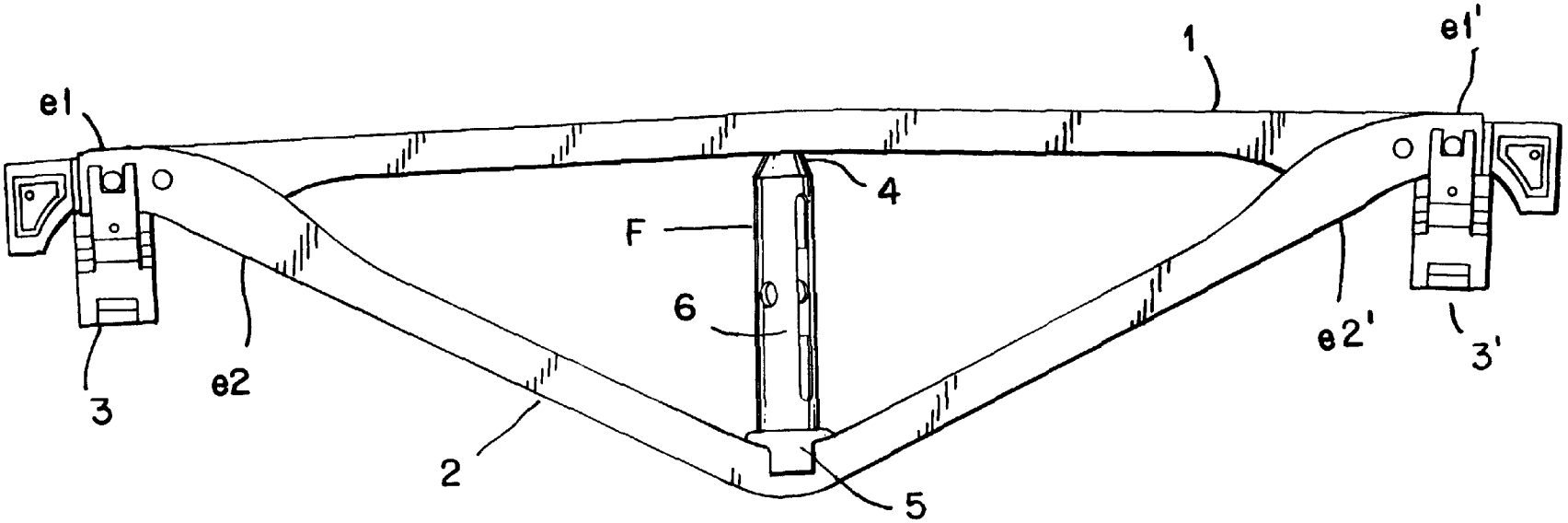
FIG. 1 is a conventional perspective view of a brake beam having a reversible fulcrum mounted in accordance with the present invention.
Figure 4:
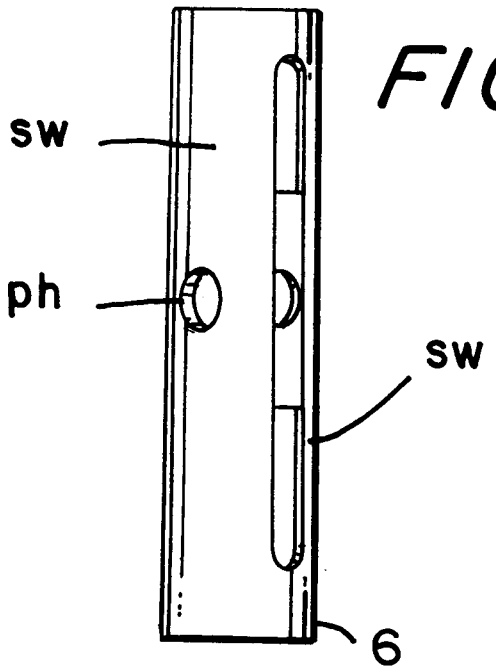
FIG. 4 is a conventional view of a preferred embodiment of the strut having a reversible fulcrum of the present invention.
Figure 5:
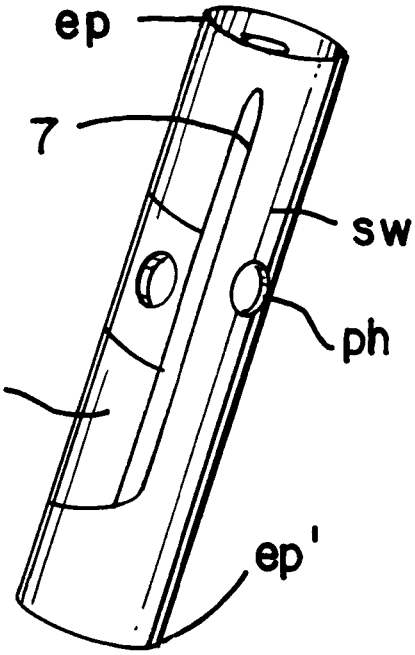
FIG. 5 is a partial perspective view of a preferred embodiment of the reversible fulcrum of the present invention.
Figure 6:
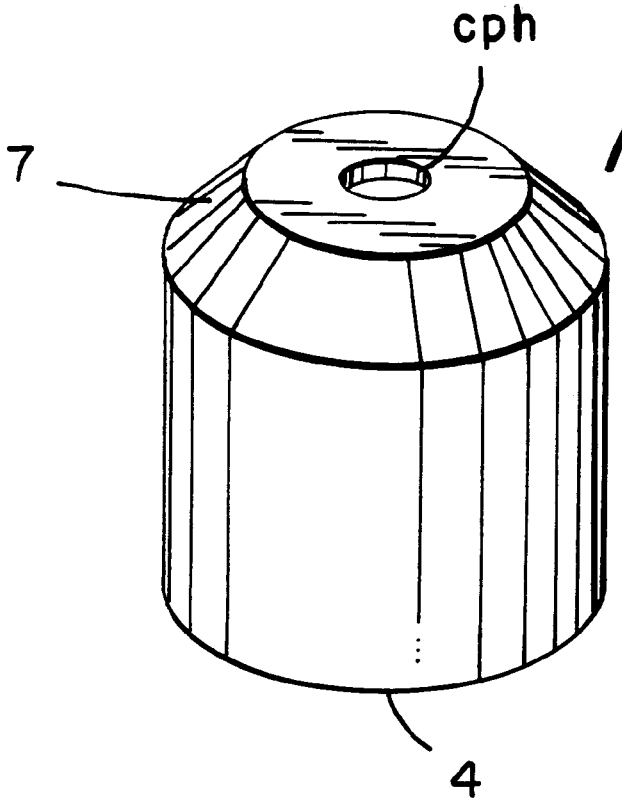
FIG. 6 is a partial perspective view of the hollow bell joint.
Figure 7:
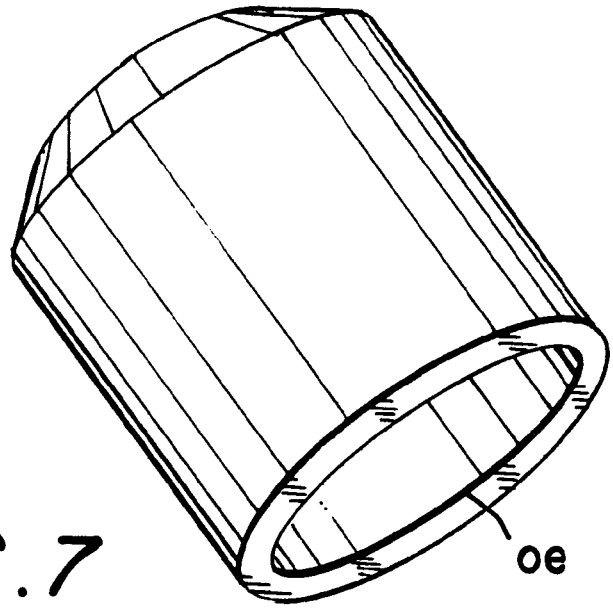
FIG. 7 is another partial perspective view of the hollow bell joint showing the open end.
Figure 8:
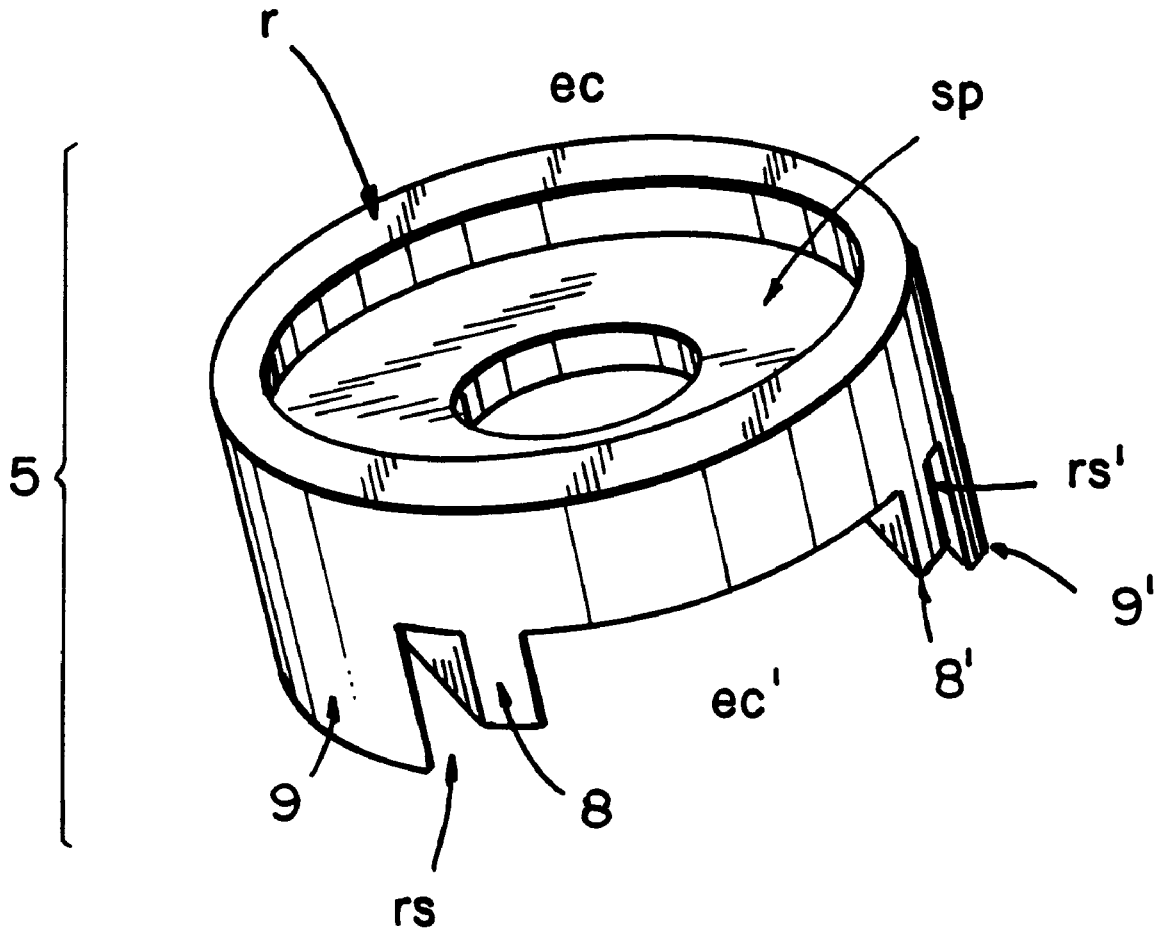
FIG. 8 is a perspective view of the crown joint of the present invention.

DETAILED DESCRIPTION OF THE INVENTION.

The reversible fulcrum, of the present invention, by which the strut can be converted from a right strut to a left strut and vice versa, will be now firstly described in relation to a brake beam, in accordance with its most general embodiment thereof, comprising:

a compression member 1, having a first end e1 and a second end e1', said compression member 1 having a channel shaped cross section including an upper wall uw1 and two depending side walls sd1, sd1', each depending from an edge of the upper wall uw1 and a bore B in a central longitudinal portion of the upper wall uw1;

a "V" shaped tension member 2 having a first end e2 and a second end e2' each of which is respectively joined to an end e1, e1' of the compression member 1, said "V" shaped tension member having a channel shaped cross section including a lower wall lw and two upwardly projecting side walls sd2,sd2', each depending from an edge of the lower wall lw;

two brake shoes 3, 3', each respectively linked to each end of the compression member 1;

a strut F comprising:

a pipe 6, having surrounding wall sw; an off-center pinhole ph passing through the surrounding wall sw at the central front longitudinal portion of the surrounding wall sw; a slot st passing through a the tube 6 at a central side longitudinal portion of the pipe 6; and a first end ep, and a second end ep';

a bell joint 4 having a dome 7 including a central pinhole cph to be joined to a central portion of the compression member 1 by a bolt (not shown), passing through the bore B of the compression member 1, so the bell joint 4 is retained inside compression member 1, and an open end oe welded to the end ep of the pipe 6;

a crown joint 5 comprising a first end ec formed by a ring r including a centrally perforated transversal support rib or wall sp; and a second end ec' including two opposite curved holding skirts 8,8' downwardly depending from the support wall sp, and two opposite holding skirts 9,9' downwardly depending from the ring r, so that retaining slots rs, rs' are formed between the skirts 8,8' and the skirts 9,9' to be inserted on the sides walls sd2 and sd2' of the tension member 2, at the central apex thereof and the pipe 6 is tightly received into the ring r and rests on the support wall sp.

The function of the off-center pinhole p, is to allow the pass of a bar trough the pipe in order to form a lever with said bar, and with the application of a moment over the bar, the fulcrum can be rotated over its own axis in order to convert a right strut to a left strut or vice versa.

Although it has been described that the tension member and the compression member have a channel shaped cross section, they could have any shape, or even been bars having any shaped cross section.

In the same way, the pipe 6 could be a cylindrical bar or any other cross section bar, and the crown does not necessarily need to have the two opposite holding skirts 9,9', since it could be retained on the tension member 2 only by the two opposite curved holding skirts 8,8', and furthermore, the crown could have any kind of holding means in order to be retained to the tension member 2 or could be welded to the same.

For security purposes, the fulcrum body may have a perforation near its second end coinciding with perforations at the crown joint in order to allow the pass of a secure bolt trough said perforations for allowing a rotary movement of the fulcrum of only +2 or −2 degrees.

Furthermore, the pipe may include an external wear shell welded to the external wall of the pipe instead of the two wear plates.

Finally it must be understood that the strut having a reversible fulcrum, of the present invention, is not limited exclusively to the embodiments above described and illustrated and that the persons having ordinary skill in the art can, with the teaching provided by the invention, to make modifications to the design and component distribution of the strut having a reversible fulcrum of the present invention, which will clearly be within of the true inventive concept and of the scope of the invention which is claimed in the following claims:

We claim:

1. A reversible fulcrum for a strut for use in brake beams of the type comprising:

a compression member having a first and a second end; a "V" shaped tension member having a central apex, a first end coupled to the first end of the compression member, and a second end coupled to the second end of the compression member; a brake shoe linked to each end of the compression member; and a strut;

wherein the reversible fulcrum comprises:

a fulcrum body having a first end and a second end; a central slot at a side portion of the fulcrum body and an off-center pinhole at a front portion of the fulcrum body;

a hollow bell joint, having a rotary dome coupled to a central portion of the compression member and a tubular open end at which the first end of the fulcrum body is coupled; and a crown joint having a first end formed by a rotary ring including a centrally perforated and annular transverse support wall, said rotary ring receiving the second end of the fulcrum body, and a second end having retaining means comprising two opposite external holding skirts depending downwardly from an external border of the crown and two opposite internal holding skirts, depending downwardly from the annular transverse support wall, whereby a retaining slot is formed between the external skirts and the internal skirts to be inserted on the side walls of a channel shaped cross section tension member at the central apex.

2. The reversible fulcrum for a strut as claimed in claim 1, wherein the fulcrum body has a perforation near its second end coinciding with perforations in the retaining means for the fulcrum of the crown joint to allow the passage of a secure bolt through said perforations to allow for a rotary movement of the fulcrum of only +2 or −2 degrees.

3. The reversible fulcrum for a strut as claimed in claim 1, wherein the retaining means of the crown joint comprises an annular support rib.

4. The reversible fulcrum for a strut as claimed in claim 1, wherein the off-center pinhole allows the passage of a bar through the fulcrum body in order to form a lever with said bar, and with the application of a moment over the bar, the fulcrum can be rotated over its own in order to convert a right strut to a left strut and vice-versa.

* * * * *